US005481165A

United States Patent [19]

Urano et al.

[11] Patent Number: 5,481,165

[45] Date of Patent: Jan. 2, 1996

[54] DRIVE DEVICE FOR A SEWING MACHINE

[75] Inventors: Akiyoshi Urano; Hiroaki Tsuboyama, both of Chofu, Japan

[73] Assignee: Juki Corporation, Tokyo, Japan

[21] Appl. No.: 279,867

[22] Filed: Jul. 26, 1994

[30] Foreign Application Priority Data

Dec. 20, 1993 [JP] Japan ..... 5-072942 U

[51] Int. Cl.[6] ..... D05B 69/12

[52] U.S. Cl. ..... 318/5; 112/217.3; 112/220

[58] Field of Search ..... 112/217.3, 217.4, 112/283, 284, 220; 318/5, 8, 11, 12, 14, 558

[56] References Cited

U.S. PATENT DOCUMENTS 3,924,550 12/1975 Boser et al. .
3,967,566 7/1976 Spiegel et al. .
4,240,368 12/1980 Adams .
4,259,915 4/1981 Szostak .
4,274,522 6/1981 Min .
4,576,103 3/1986 Albrecht et al. .
4,993,995 2/1991 Okazaki .

FOREIGN PATENT DOCUMENTS 897799 5/1962 United Kingdom .
1033334 6/1966 United Kingdom .
1271266 4/1972 United Kingdom .
1318350 5/1973 United Kingdom .
1375540 11/1974 United Kingdom .

*Primary Examiner*—Bentsu Ro
*Attorney, Agent, or Firm*—Finnegan, Henderson, Farabow, Garrett & Dunner

[57] ABSTRACT

A drive device for a sewing machine comprises a high speed main motor having a power transmitting flywheel, and a low speed auxiliary motor having a power transmitting pulley. The power transmitting flywheel and the power transmitting pulley being mounted through a one-way clutch on the upper shaft of the sewing machine.

2 Claims, 4 Drawing Sheets

DRIVE DEVICE FOR A SEWING MACHINE

BACKGROUND OF THE INVENTION

1. Field of the Invention

This invention relates to a sewing machine, and more particularly to a drive device provided for the sewing machine which is adapted to drive a main shaft and other mechanisms subjected to transmission from the main shaft.

2. Description of the Related Art

A clutch motor as shown in FIG. 1 have been known as a sewing machine motor in the art. The clutch motor is constructed as follows: A flywheel 2 is fixedly mounted on an output shaft 1*a* of a motor body 1, which is continuously rotated. A clutch plate 5 is rotatably supported by a movable bearing 4, which is axially, movably supported by a motor frame 3. A lever 7 provided to move the movable bearing 4 axially is urged by a lever return spring 8 so that the clutch plate 5 is pushed against a brake shoe 6. When the lever 7 is at rest, the clutch 5 is maintained pushed against the brake shoe 6, and therefore a sewing machine pulley 10 is held stopped. By pushing down the lever 7, the clutch wheel 5 is brought into contact with the flywheel 2, so that the sewing machine pulley 10 is turned.

The drive device for the sewing machine of this type is designed so that the main shaft is rotated at a low speed because it is locked to a one-way clutch upon rotation of a pulley adapted for power transmission to a low speed auxiliary motor as rotated when the main motor is in a neutral position. In this condition, the clutch plate 5 is out of contact with the flywheel 2 and the brake shoe 6, as shown in FIG. 1. The main shaft is rotated at a high speed in the same direction simultaneously with idling the pulley upon rotation of the main motor when the auxiliary motor stops. A disadvantage derived from the conventional drive device is that a transmission mechanism is complex and costly when a mechanism is used wherein the aforementioned clutch motor is employed for low speed controls such as needle position control and thread cutting or trimming.

SUMMARY OF THE INVENTION

A primary object of the present invention is a drive device which is simple in structure and capable of transmitting power to the sewing machine.

Another object of the present invention is a drive device adapted to selectively transmit rotation of two motors different in rotational speed in the same direction to the main shaft to reduce the cost.

The foregoing objects of the invention have been achieved by the provision of a drive device for a sewing machine which, according to the present invention, comprises a high speed main motor having a power transmitting flywheel, and a low speed auxiliary motor having a power transmitting pulley. The power transmitting flywheel and the power transmitting pulley are mounted through a one-way clutch on the main shaft of the sewing machine.

The drive device designed as described above operates as follows: When, with the main motor in the neutral position where the low speed auxiliary motor is rotated, the power transmitting pulley is turned, so that the one-way clutch is locked, and the upper shaft is rotated at low speed. When, with the low speed auxiliary motor stopped, the main motor is rotated, the flywheel is rotated, and the upper shaft is rotated at high speed in the same direction, while the power transmitting pulley of the low speed auxiliary motor idles.

DETAILED DESCRIPTION OF THE PREFERRED EMBODIMENTS

Figure 1:
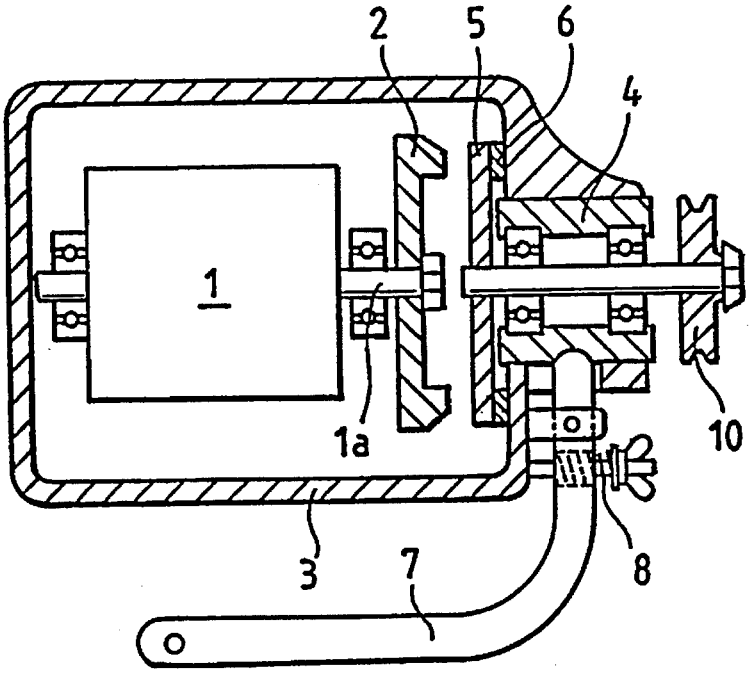
FIG. 1 PRIOR ART
FIG. 1 is a sectional view a conventional sewing machine drive device.
Figure 2:
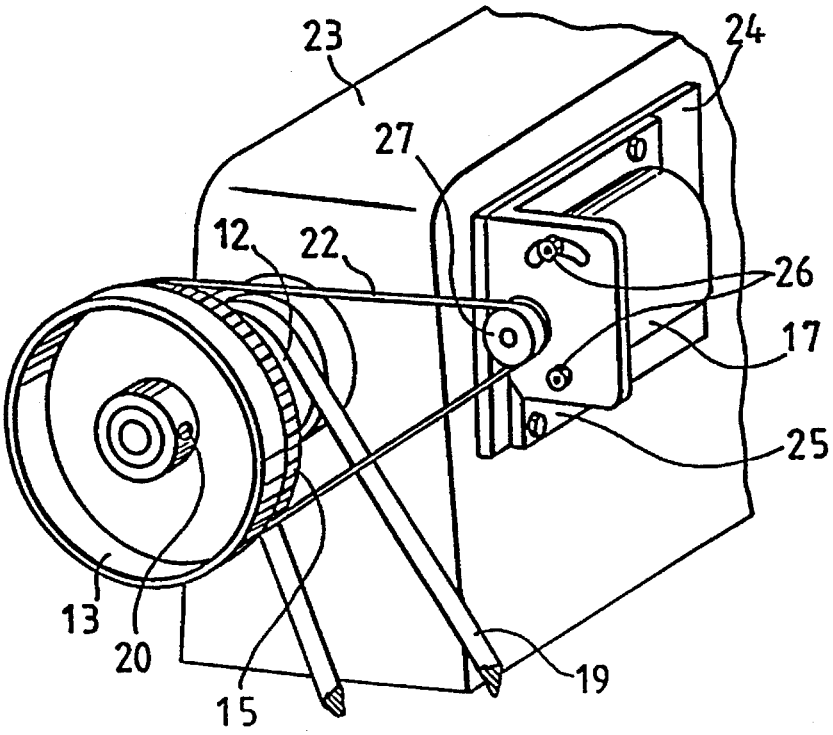
FIG. 2 is a perspective view showing a sewing machine drive device according to the invention.
Figure 3:
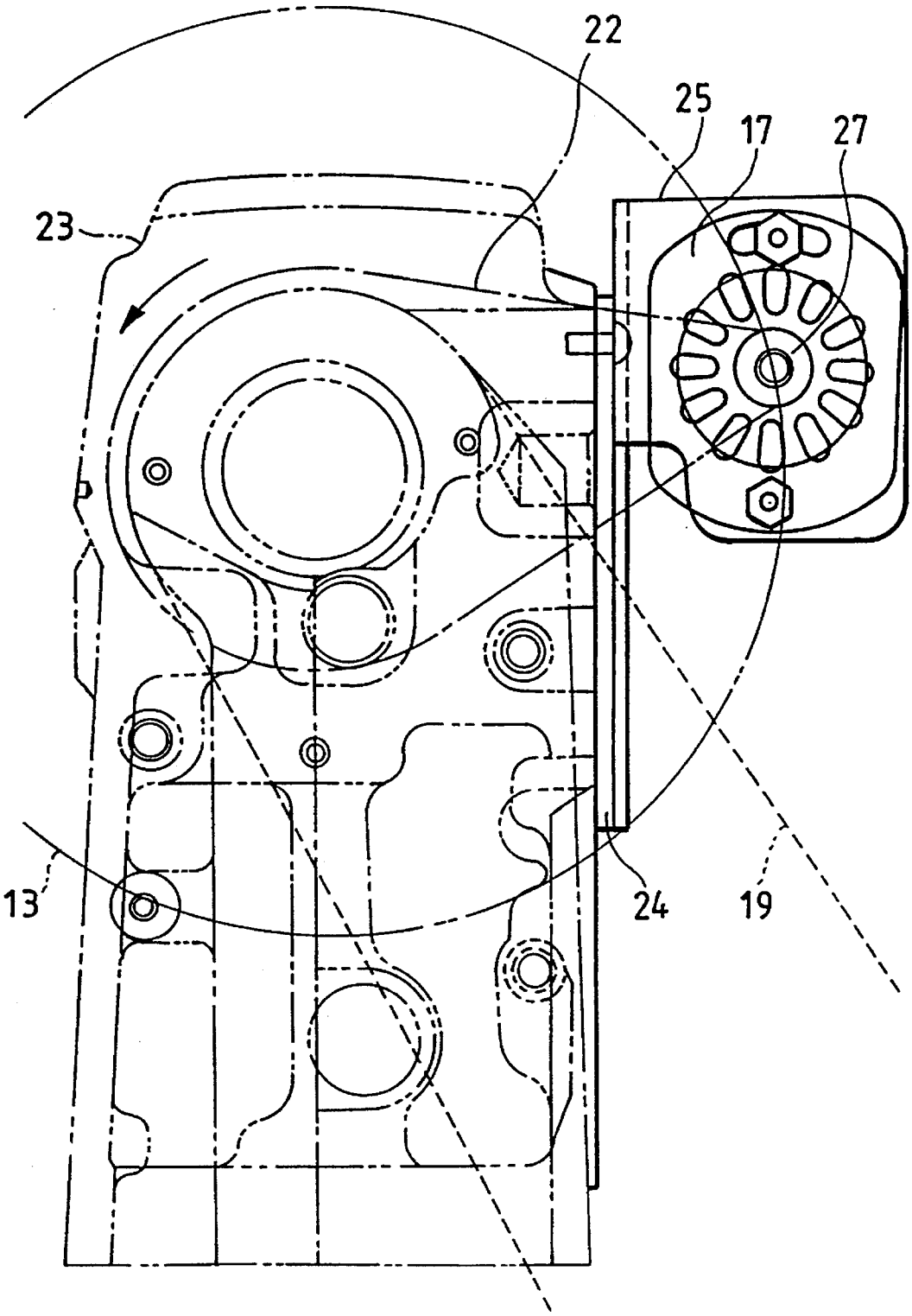
FIG. 3 is a side view of the sewing machine drive device according to the invention.
Figure 4:
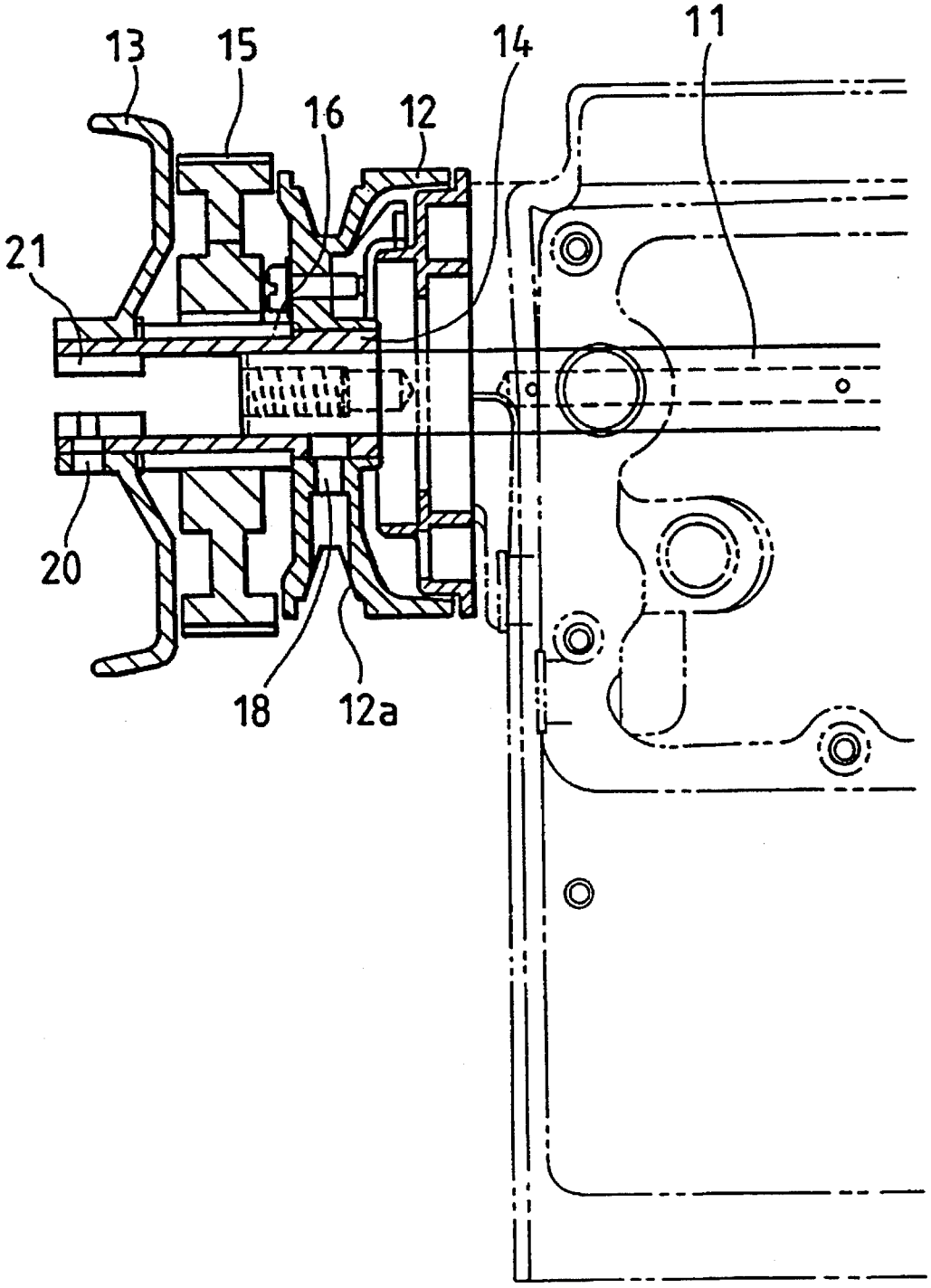
FIG. 4 is a rear view of the sewing machine drive device according to the invention.

A drive device provided for a sewing machine according to the invention will be described with reference to FIGS. 2 through 5.

The drive device is designed as follows: A flywheel 12 and a hand pulley 13 are fixedly mounted through a flywheel bushing 14 on a main shaft 11 of the sewing machine. A main shaft timing pulley 15, into which a one-way clutch 16 is press-fitted, is fitted on the flywheel bushing 14. The upper shaft timing pulley 15 thus fitted cooperates with a low speed auxiliary motor 17.

The flywheel bushing 14 is press-fitted into the central hole of the flywheel 12, and then it together with the flywheel 13 is fixedly mounted on the upper shaft 11 by fixing screws 18.

The flywheel 12 is provided peripherally thereof with an annular groove 12*a* of V-shaped in section which a V-belt 19 connects. The V-belt is trained between the flywheel 12 and a pulley of a high speed main motor (not shown).

The hand pulley 13 is fixedly secured to the flywheel bushing 14 by a collar 21 and fixing screws 20. As is apparent from the above description, the flywheel 12, the flywheel bushing 14, the upper shaft 11 and the hand pulley 13 turn as one unit.

The main shaft timing pulley 15 is formed peripherally thereof with serrations for connecting the timing belt thereon.

On the other hand, a sewing machine body 23 has a window plate 24 on the rear side through which internal part installation and adjustment are carried out. The low speed auxiliary motor 17 is fixedly mounted on a motor mounting stand 25 by fixing screws 26 and 26 which are secured to the window plate 24 of the sewing machine body 23. A timing belt 22 is laid over a motor timing pulley 27 of the low speed auxiliary motor 17 thus mounted and the upper shaft timing pulley 15.

Figure 5A:
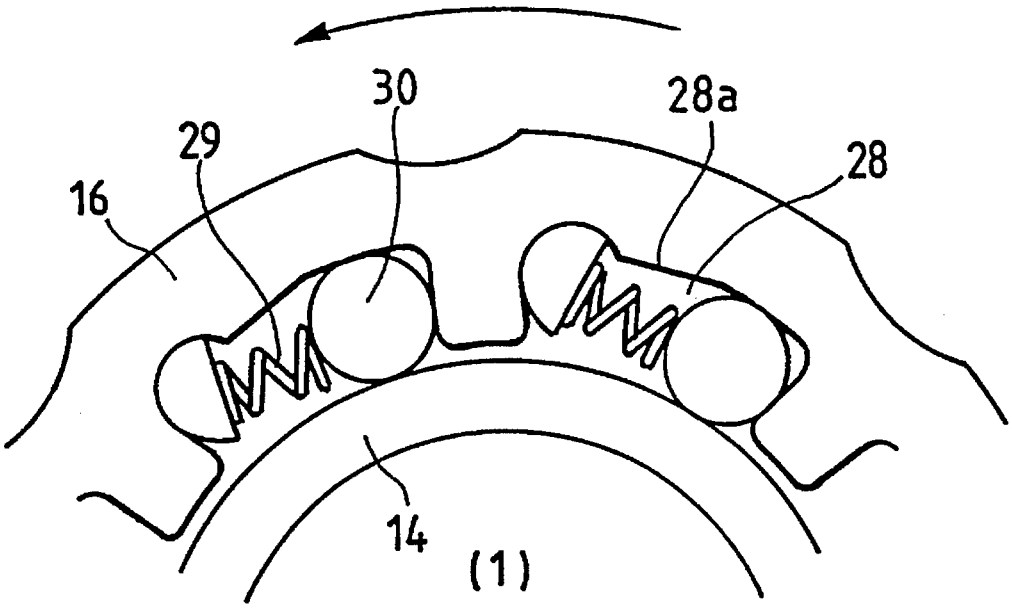
FIGS. 5(A) and 5(B) are views explanatory of the manner in which the drive device is actuated depending on the directions where a one-way clutch is rotated.
Figure 5B:
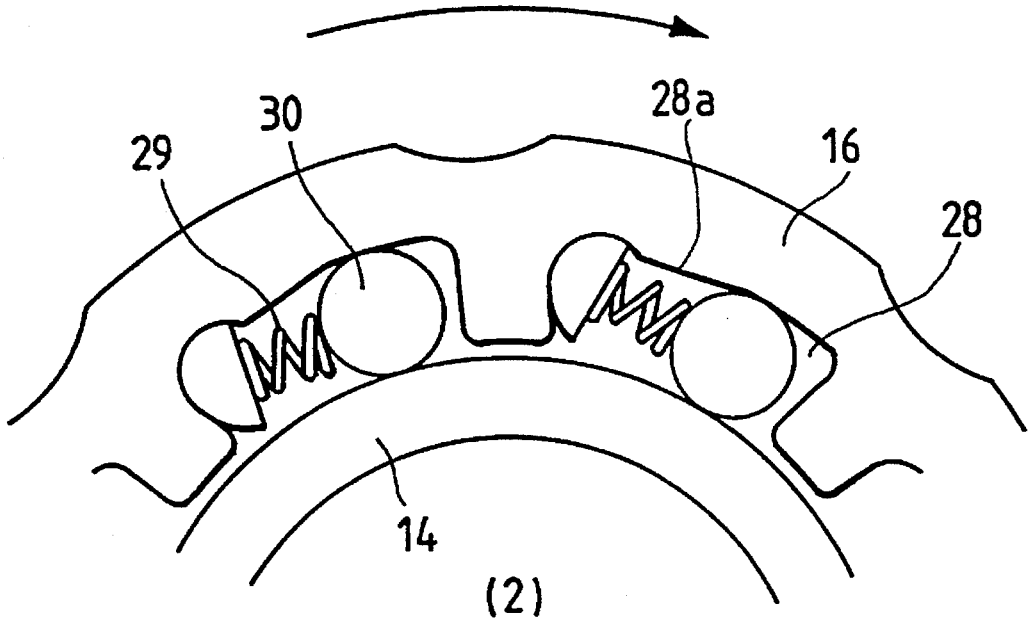

The one-way clutch 16 is to allow the upper shaft timing pulley 15 to freely rotate only clockwise as viewed from the side of the pulley. The one-way clutch 16 is typically as shown in FIGS. 5(A) and 5(B). That is, the one-way clutch 16 has small spaces 28 with cam surfaces 28*a* in each of which a spring 29 and a roller 30 are arranged.

As the one-way clutch 16 is turned in the direction of the arrow in the part FIG. 5(A), in each of the small spaces 28, the spring 29 acts to move the roller 30 until the latter 30 is engaged with the cam surface 28*a*. As a result, the roller 30 serves as a wedge, the flywheel pushing 14, the flywheel 12, the upper shaft 11 and the hand pulley 13 are turned. That is, when, with the main motor stopped, the low speed auxiliary motor 17 is rotated, the drive force is transmitted through the timing belt 22 to the upper shaft timing pulley 15, so that the latter 15 is turned counterclockwise, and the one-way clutch 16 is locked, and the upper shaft 11, the flywheel 12 and the hand pulley 13 are turned counter-clockwise at low speed.

When, in contrast, the one-way clutch is turned in the direction of the arrow in FIG. 5(B), the flywheel bushing 14 is turned relatively in the opposite direction, so that the rollers 30 are disengaged from the cam surfaces 28*a*, thus idling with respect to the flywheel bushing 14. That is, when, after the low speed auxiliary motor 17 is stopped, the main motor is rotated, the drive force is transmitted through the V-belt 19 to the flywheel 12, so that the upper shaft 11, the flywheel 12, and the hand pulley 13 are rotated counter-clockwise at high speed, while the upper shaft timing pulley 15 idles.

The motor device designed as described above has the following effects or merits:

The motor device is simple in structure, being formed by providing the low speed auxiliary motor and the one-way clutch. With the motor device, the rotations of the two motors different in speed can be selectively applied to the upper shaft of the sewing machine in the same direction, which contributes to a reduction of the manufacturing cost.

What is claimed is:

1. A drive device for a sewing machine comprising:

an upper shaft for driving the sewing machine;

a power transmitting flywheel fixedly mounted on said upper shaft so that said power transmitting flywheel and said upper shaft turn as one unit;

a high speed motor for rotating said power transmitting flywheel;

a one-way clutch mounted about said upper shaft;

power transmitting pulley mounted outside of said one-way clutch; and a low speed motor for rotating said power transmitting pulley at lower speed than said power transmitting flywheel.

2. A drive device for a sewing machine according to claim 1 wherein said one-way clutch allows rotation of said power transmitting pulley, said power transmitting flywheel and said upper shaft as one unit when said power transmitting pulley is driven to rotate, and wherein said one-way clutch frees said power transmitting pulley from rotation when said transmitting flywheel is driven to rotate.

* * * * *